US007823607B2

(12) United States Patent
Eide

(10) Patent No.: US 7,823,607 B2
(45) Date of Patent: Nov. 2, 2010

(54) SYSTEM TANK AND OUTPUT UNIT FOR TRANSPORTING UNTREATED DRILL CUTTINGS

(75) Inventor: Anders Eide, Tolvsrod (NO)

(73) Assignee: Ing. Per Gjerdrum AS (NO)

( * ) Notice: Subject to any disclaimer, the term of this patent is extended or adjusted under 35 U.S.C. 154(b) by 629 days.

(21) Appl. No.: 10/597,548

(22) PCT Filed: Sep. 29, 2004

(86) PCT No.: PCT/NO2004/000289

§ 371 (c)(1),
(2), (4) Date: Jul. 28, 2006

(87) PCT Pub. No.: WO2005/073500

PCT Pub. Date: Aug. 11, 2005

(65) Prior Publication Data

US 2007/0183853 A1 Aug. 9, 2007

(30) Foreign Application Priority Data

Jan. 29, 2004 (NO) ..... 20040412
Feb. 26, 2004 (NO) ..... 20040861

(51) Int. Cl.
*E21B 21/06* (2006.01)

(52) U.S. Cl. ..... 137/899.2; 175/66; 366/196; 222/236; 414/141.9

(58) Field of Classification Search ..... 137/899.2; 175/66, 206, 207, 217, 218; 366/195, 196; 414/140.7, 141.9; 222/236, 460, 462
See application file for complete search history.

(56) References Cited

U.S. PATENT DOCUMENTS 1,067,174 A * 7/1913 Johnson ..... 222/279
2,574,231 A * 11/1951 Sinden ..... 222/227
3,945,537 A * 3/1976 Langen ..... 222/240

(Continued)

FOREIGN PATENT DOCUMENTS

EP 0108864 A2 7/1983

(Continued)

*Primary Examiner*—John Fox
(74) *Attorney, Agent, or Firm*—Brooks Kushman P.C.

(57) ABSTRACT

System for transport of untreated drill cuttings, comprising a tank (2). The tank (2) is arranged below the deck of a ship (1) and has an output unit (10) at the bottom (6), to feed the drill cuttings towards an output opening (8). A pump (21) is provided below the bottom of the tank (2) to feed the drill cuttings through an unloading line (13). The unloading line (13) has a substantially uniform cross section and is shaped so that the velocity of the flow close to the inner wall is substantially equal in the same cross section. The tank (2) has an upper circular cylindrical part (3) and a lower frustuconical part (4) and a substantially flat bottom (6). In the flat bottom (6) is an output opening (8), which extends from the side wall (5) of the frustuconical part (4) to an inner dome or cone (11).

14 Claims, 8 Drawing Sheets

U.S. PATENT DOCUMENTS

| | | | | |
|---|---|---|---|---|
| 4,487,339 | A * | 12/1984 | Ellwood | 222/236 |
| 5,964,304 | A * | 10/1999 | Morrison et al. | 175/38 |
| 6,179,070 | B1 * | 1/2001 | Dietzen | 175/66 |
| 6,585,115 | B1 * | 7/2003 | Reddoch et al. | 209/3 |
| 6,709,217 | B1 * | 3/2004 | Snowdon | 414/137.1 |
| 6,745,856 | B2 * | 6/2004 | Simpson et al. | 175/66 |
| 6,796,379 | B1 | 9/2004 | Martin | |
| 6,926,101 | B2 * | 8/2005 | deBoer | 175/70 |
| 6,988,567 | B2 * | 1/2006 | Burnett et al. | 175/66 |
| 7,195,084 | B2 * | 3/2007 | Burnett et al. | 175/66 |
| 2003/0190199 | A1 | 10/2003 | Snowdon | |

FOREIGN PATENT DOCUMENTS

| | | |
|---|---|---|
| GB | 2318370 | 4/1998 |
| GB | 2369135 | 5/2002 |
| GB | 2393744 | 7/2004 |

* cited by examiner

SYSTEM TANK AND OUTPUT UNIT FOR TRANSPORTING UNTREATED DRILL CUTTINGS

The present invention regards a system for transport of untreated drill cuttings. "Untreated" means that the drill cuttings have not undergone any significant treatment with a view to preparing the cuttings for transport, e.g. through the addition of liquid.

Drilling of boreholes during oil and gas exploration generates a large quantity of drill cuttings. These drill cuttings consist of ground rock, water and residues of various chemicals that are used as additives during the drilling operation. It may also contain hydrocarbons such as oil.

Earlier, the drill cuttings were simply disposed of on the seabed. However research has revealed that the drill cuttings can be highly damaging to the environment and in particular very damaging to pelagic fish spawn. Therefore, many countries today do not allow dumping of drill cuttings on the seabed in sensitive areas. Thus the drill cuttings must be transported to shore for treatment or alternatively be milled and reinjected. On shore, drill cuttings can be disposed of in an environmentally sound manner. There are also several ways in which fractions of the cuttings can be exploited commercially prior to disposing of the remaining waste.

There are many systems for separating drill cuttings from well drilling fluid. Examples thereof are described in Nos. 311232, 312915, 19985493, 19991798, U.S. 2001/0039887, GB 2350851

From WO 01/38648 there is also known a system for removing dumped drill cuttings from the seabed.

The systems currently used for transport are highly labour-intensive and there is general unhappiness about the amount of crane handling involved, especially on the rig. The systems on the supply ships are also labour-intensive and space-requiring. No current proposals exist for systems that in a satisfactory manner could handle the transport of untreated drill cuttings below deck. Today the most common mode of transport is for the drill cuttings to be filled in open skips onboard the drilling platform (or ship), as described in U.S. Pat. No. 5,971,084, No. 20032400 (corresponding to U.S. Pat. No. 6,585,115), WO 03/095789 and No. 19995270. Then the skips are lifted onboard a supply ship by means of a crane. The skips are then transported to a shore receiving plant on the deck of the supply ship. Such deck transport is not considered safe. If the supply ship hits rough weather there will be a risk of the skips ending up in the sea, either through deliberate emergency dumping or by working loose. Thus it would be highly desirable to be able to transport the drill cuttings below decks.

Drill cuttings are highly viscous. Attempts have been made to transport drill cuttings in tanks comprising agitators to keep the drill cuttings as liquid as possible. However, this has resulted in the drill cuttings partly turning into a hard concrete-like mixture which is impossible to pump. In the case of skip transport this is of no great consequence, as the skips may be emptied more or less by turning them upside down. However, this is not possible when using ship tanks, and petrified drill cuttings can prove almost impossible to remove. It has also been proposed that liquid be added in order to keep the drill cuttings liquid. However, this does not solve the problem, in addition to which large quantities of liquid must now also be transported. Examples of the above are described in U.S. Pat. No. 6,345,672 and GB 2330600.

No. 20021070 proposes transport of drill cuttings in tanks towed behind a ship. This will of course entail a great risk of pollution if a tank were to break adrift.

Despite the problems of the method proposed in U.S. Pat. No. 6,345,672 and GB 2330600, the invention is still based on using tanks arranged below deck, e.g. in a supply ship, for the transport of drill cuttings. Unlike in previous attempts, work on the present invention has led to the conclusion that the design of the tank and the output mechanism has a great influence on whether the drill cuttings can be delivered from the tank. The agitation previously carried out when attempting to find a solution to the transport problem, either during the actual transport or when feeding the drill cuttings from the tank, has proven to have a very negative effect on the viscosity of the drill cuttings. The greater the agitation of the drill cuttings, the greater the degree of petrifaction. This is because the particles are compressed locally in the drill cuttings, causing displacement of water and an increase in particle density. Thus it is an object of the present invention to avoid to the greatest possible extent any stirring of the drill cuttings.

Another possible solution is to dry the drill cuttings prior to transport to allow it to be transported as a powder. However, such drying requires a lot of energy and some time to carry out, leading to an increased requirement for storage space onboard the platform.

In order to succeed with the above object the tank has been given an appropriate design, where the drill cuttings are conducted towards the tank outlet with a minimum of stirring and the output mechanism is designed in such a manner as to subject the drill cuttings to as little agitation as possible during feed-out.

According to a first aspect the invention is an overall concept comprising the design of the tank, output mechanism, a controlled gate valve down into the pump feed hopper, and piping. A practical overall system is achieved by the characteristics stated in the following claim 1.

A second aspect of the present invention provides a tank for transport of drill cuttings, which achieves the intended effect by the characteristics stated in the characterizing part of the following claim 5.

A third aspect of the invention provides an output mechanism that achieves the intended effect by the characteristics stated in the characterizing part of the following claim 9.

Preferably the pump has an independent variable speed feed screw. It is further possible to add liquid containing chemicals and perform air blasting.

Preferably, the operation of the pump and the output process is controlled in terms of pressure, rpm and torque, with monitoring of the level of drill cuttings in the feed hopper and protection against dry running.

The invention will now be explained in greater detail with reference to the accompanying drawings, in which.

Figure 1:
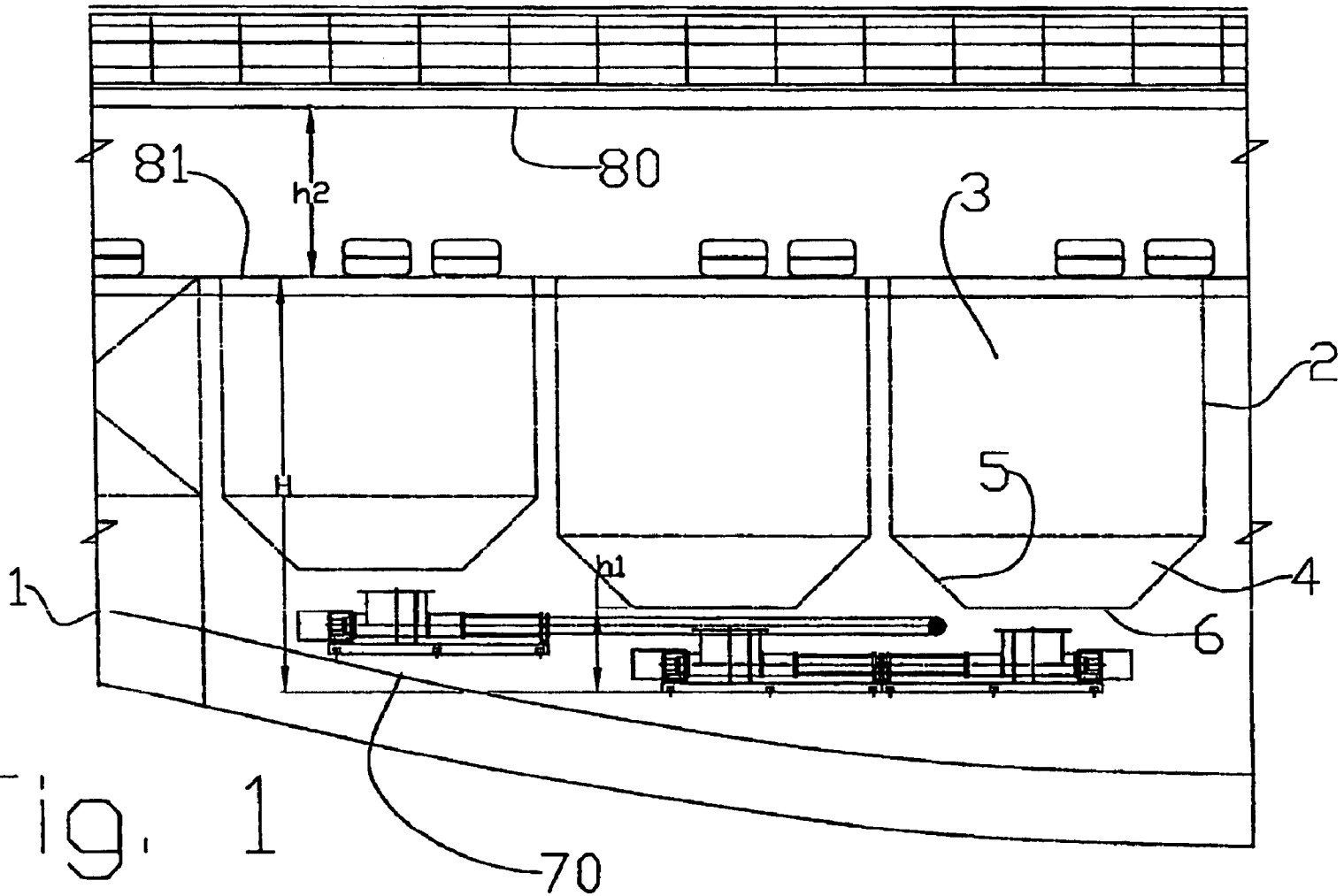
FIG. 1 is a longitudinal section through a section of a ship containing drill cuttings tanks according to the invention.
Figure 2:
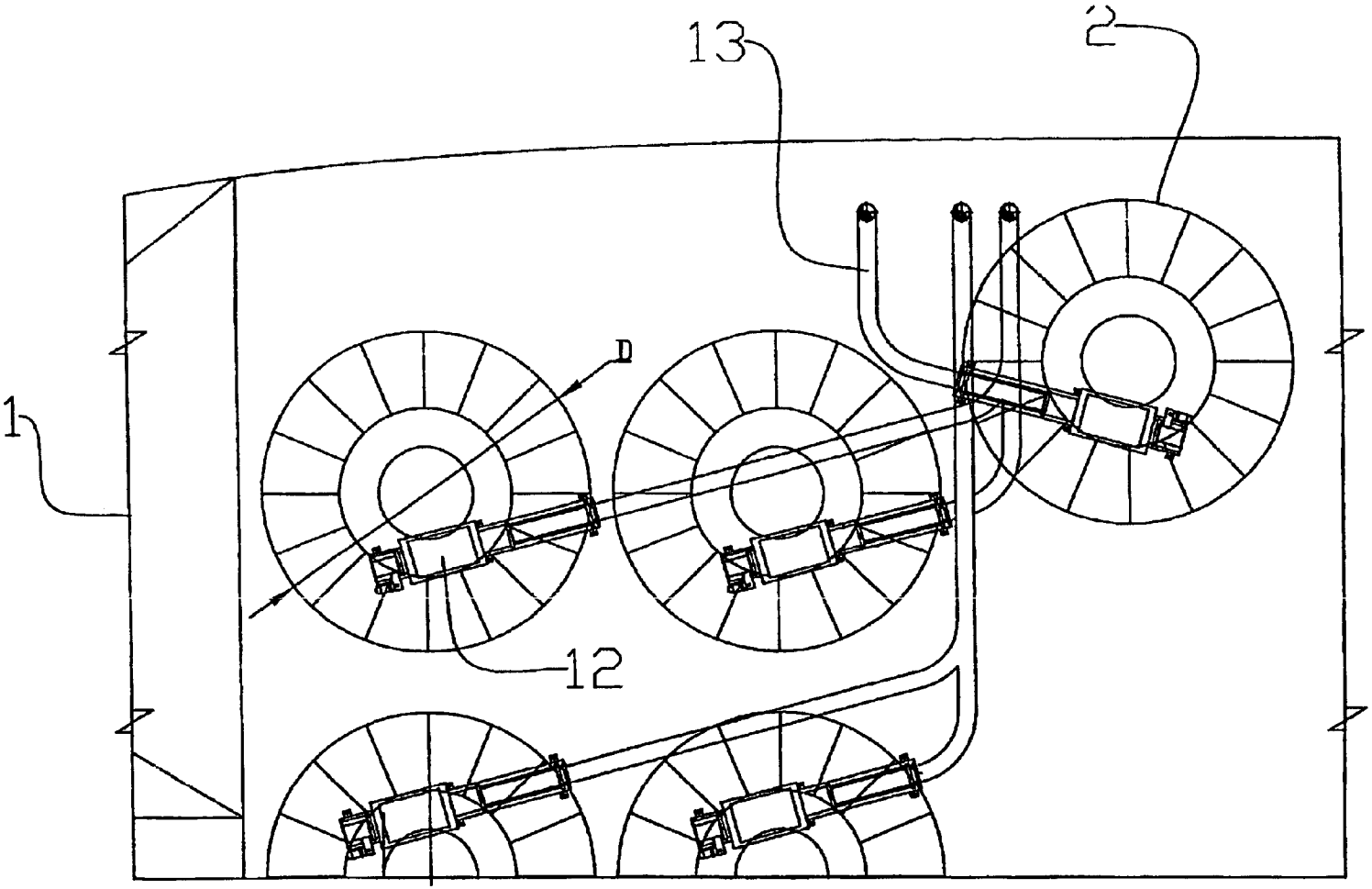
FIG. 2 is a top view of the ship section and tanks.

FIGS. 1 and 2 show vertical and horizontal, respectively, sections of a ship 1 in which there is disposed a plurality of tanks 2 according to the invention. Preferably, each tank 2 has a circular cross-section, where the upper part 3 is cylindrical and the lower part 4 is formed as the frustum of a cone having a side wall 5 that extends at an angle of between approximately 20° and approximately 45° in towards a circular flat bottom 6. This tank shape is a compromise between making good use of the available space and managing to subject the mass to be transported out through an opening in the tank 2 bottom 6 to a minimum of agitation during output. Maximum utilization of the available space is achieved by designing the tanks to have a rectangular cross-section and placing them against each other with straight side walls. However this will not give efficient output of the mass, as a lot of mass will remain in the lower corners of the tank. A cylindrical form (i.e. with a straight side wall) would also leave mass up against the side wall in the lower part of the tank.

The most efficient output would probably be achieved with a tank formed as a cone having an output orifice at the cone point. The steeper the cone walls, the easier the output process will be. However, such a tank does not make good use of the available space.

A compromise between making use of the space and achieving a good output would be to have a top part in the form of a cylinder and a lower part in the form of a cone. It has been found that a truncated cone will provide sufficient output capability while increasing the height available for a cylindrical portion.

The overall available height H is determined by the distance between the ship's bottom 70 (internal double bottom) and the deck 81. This height H varies from one ship to another and within the same ship. To be deducted from this height is the overall height $h_1$ of the pumping-equipment below the tank. Between the deck 81 and the top cargo rail 80 is a height $h_2$ which is available for connection of hoses, feed nozzle or similar.

The diameter D of the cylindrical portion 3 of the tank should as a minimum be 3 metres. Using a smaller diameter than this would not be expedient. Neither should the diameter exceed half the width of the ship, as this would be making less than good use of the available space. At present, 7 metres is considered to be the maximum practical diameter.

In order to ensure satisfactory output of the mass being transported, the width of the output orifice 8 (see FIG. 4) should be at least 300 mm. However, output orifices larger than 600×800 mm are not considered practical, as it will be difficult to design valves that have an opening larger than this, while at the same time being able to bear the weight of the mass contained in the tank. The valve can be rectangular as shown, alternatively circular or oval.

Figure 4:
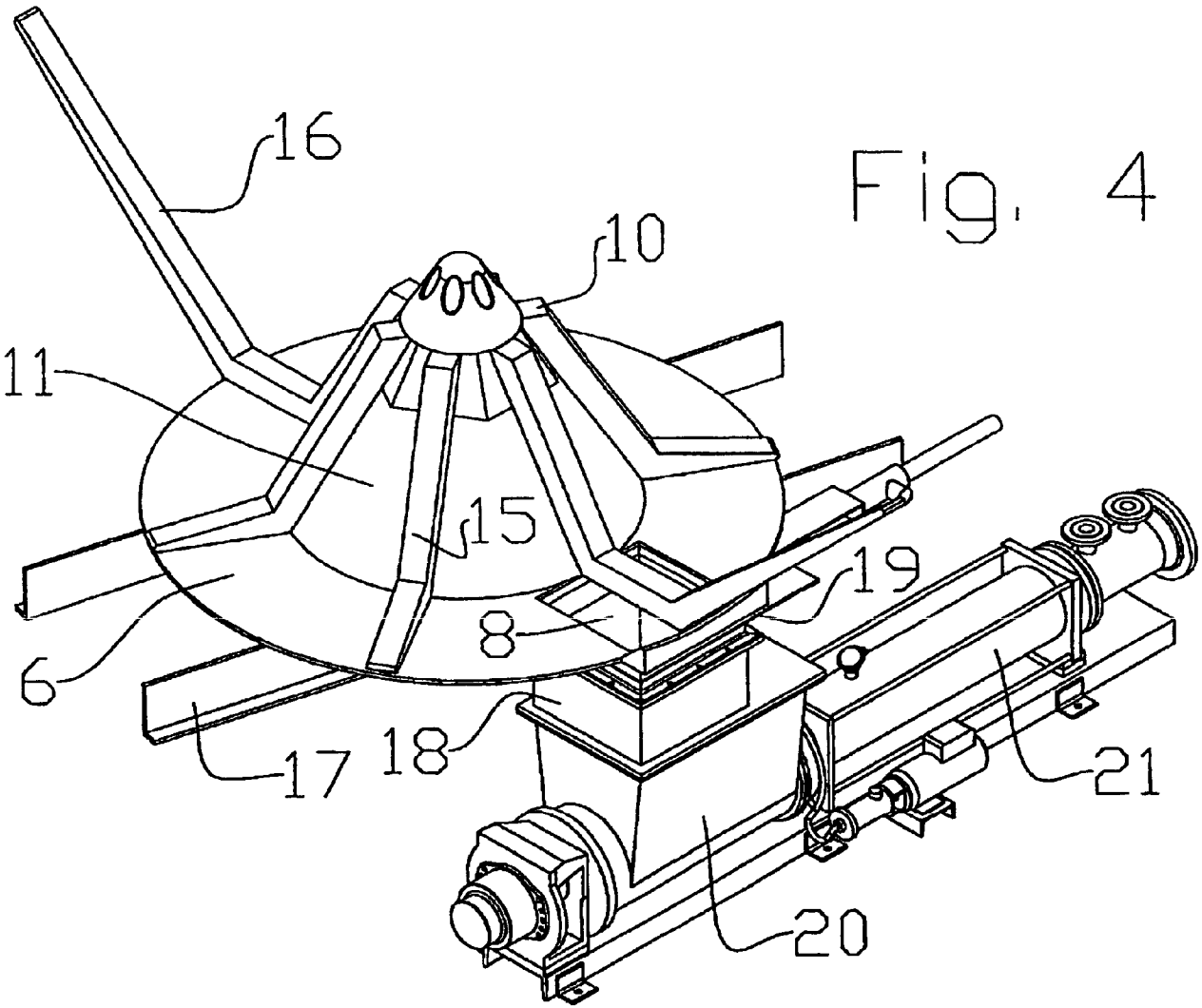
FIG. 4 shows an output mechanism according to the invention and an output pump for a tank according to the invention.

A brief reference is made to FIG. 4, which among other things shows an output unit 10 disposed immediately above the flat bottom 6. In this figure, the tank wall 5 and upper section 3 are not shown. The output unit 10 will be explained in greater detail below, but reference is here made to the fact that the output unit 10 has a generally conical part 11 that takes up a small part of the tank 2 volume. The conical part has an angle approximately equal to or steeper than the angle of the side wall 5. Because of this cone 11 only an outer part of the bottom 6 will be exposed to the mass contained in the tank 2. The width b of this outer part should be virtually equal to the width of the orifice 8. The orifice 8 may be rectangular or circular.

The above limitations will ensure a virtually unique definition of the tank shape. A deviation from this shape will lead to a poorer utilization of space or complicate the mass output process.

Figure 3:
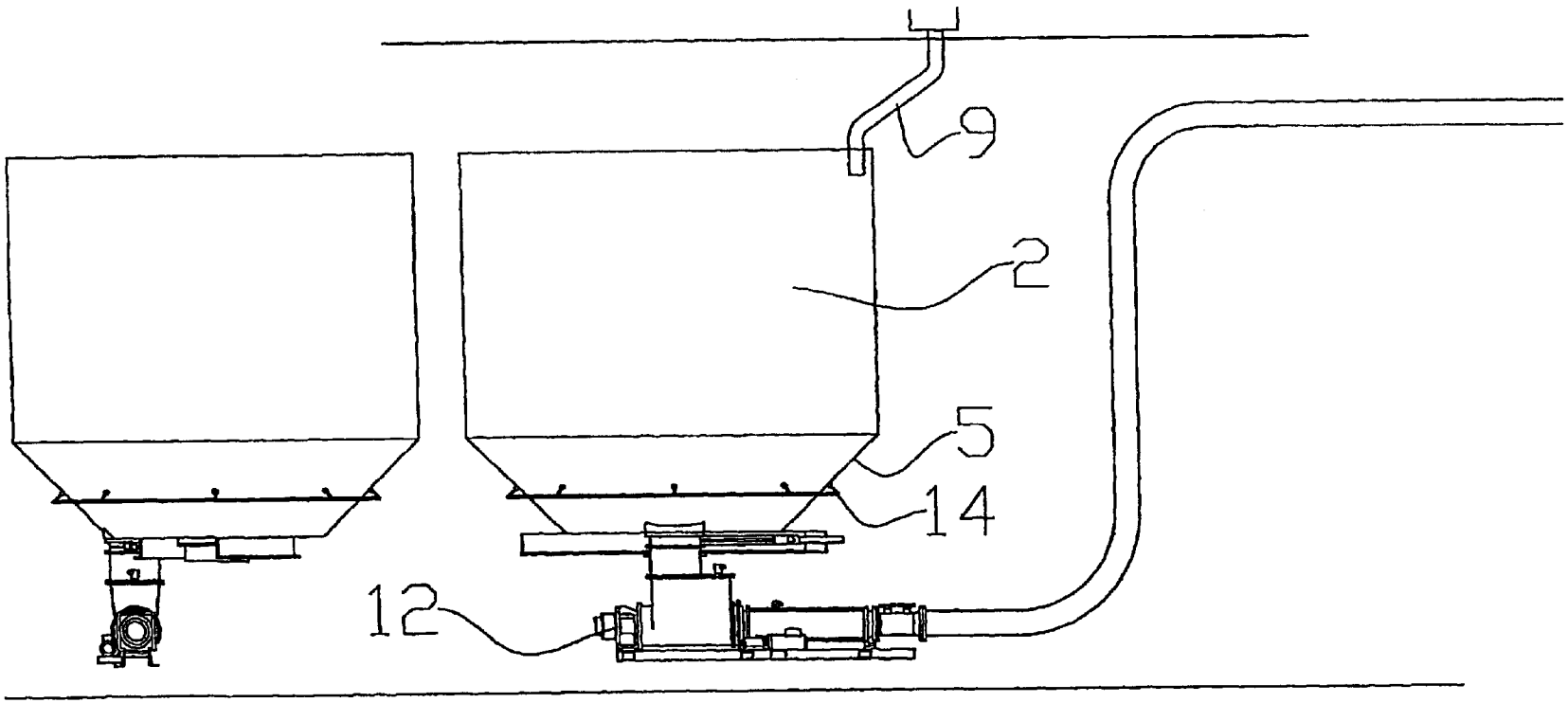
FIG. 3 shows two tanks according to the invention with associated output pump and piping.

FIG. 3 shows, in greater detail, two tanks 2 with associated pumping equipment 12. A filling device 9 is shown in connection with one of the tanks 2. Filling can take place from one or more similar tanks on board a drilling platform or a drilling ship. Alternatively, the filling can take place through a skip or big bag being emptied into a hopper (not shown) above the filling device 9. The filling device may be common to all the tanks 2 on board the supply ship 1 and be moved from tank to tank, or there may be a separate filling device 9 for each tank.

The pumping equipment 12 will be explained in greater detail later. From the pumping equipment 12 the mass is passed into a pipe or a hose 13 or a combination of a pipe and hose. The pipe or hose 13 should have as few internal dimensional changes as altogether possible. Also, it should not have too many or excessively sharp bends. This is to avoid water being driven out of the drill cuttings, making it difficult to transport the cuttings through the pipe 13. The pipe 13 runs to a receiving arrangement (not shown) on shore, which may consist of skips, big bags, tanks or a land fill site.

FIG. 3 also shows a system 14 for introducing air to the side wall 5. This can be done in blasts, especially upon commencement of the output process, in order to make it easier for the output unit to move the mass.

The output unit 10 is shown in FIG. 4, placed against the flat bottom 6. It has a cone or dome 11 that is designed to rotate. Preferably the cone has the same angle as the side wall 5 of the conical part 4 of the tank. On the dome 11 there are output arms 15, 16. Two arms extend down along the cone 11, along the flat bottom 6 and up along the side wall 5. Preferably these arms 16 are arranged so as to be diametrically opposed in order to balance the forces acting on the output mechanism. It is also possible to have only one arm 16 or more than two arms 16. The arms 15 also extend down along the cone 11 and along the bottom 6 but terminate at the periphery of the bottom 6. The cone 11 need not necessarily be conical but can have any dome shape that ensures movement of the mass down towards the flat bottom 6.

Sliding rails (not shown) may be provided in order to reduce the friction between the arms and the side wall of the conical part, which rails extend substantially in the rotational direction of the arms.

Preferably the arms are formed to lie closer against the bottom at the leading edge, so as to form a gap between the arm and the bottom, which expands towards the trailing edge of the arm. This helps avoid wedging of particles between the arm and the bottom.

FIG. 4 shows part of a supporting beam 17 for the tank 2.

Figure 5:
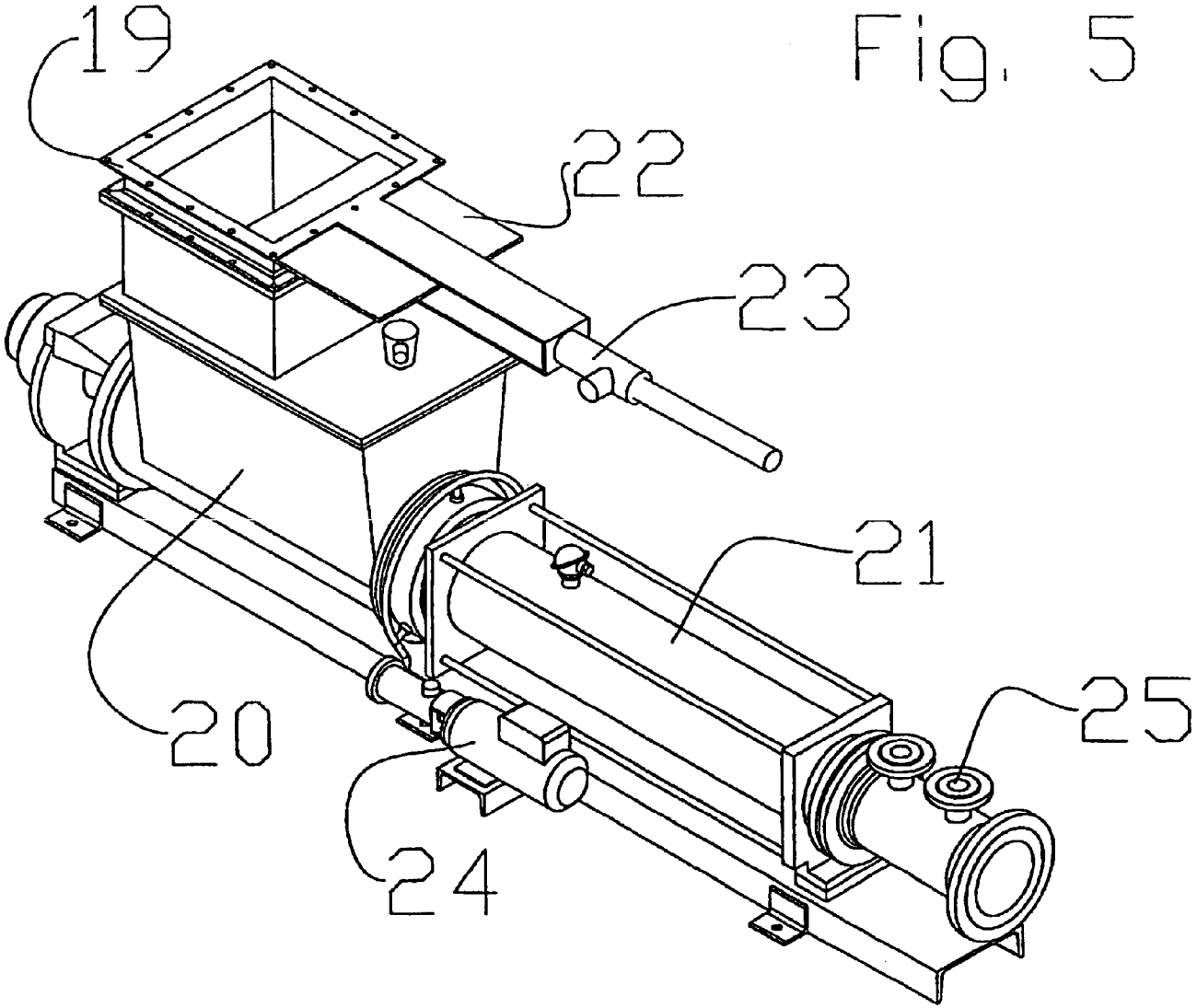
FIG. 5 shows a pump for a tank of the invention, together with a feed hopper and valve according to the invention.

Underneath the output orifice 8 there is a shaft 18 with a gate valve 19. A gate valve is considered to be the type of valve best suited for this application, as it can bear the high weight of the mass. The shaft 18 leads down to a receiving chamber 20, which in turn leads to a displacement pump, preferably a screw pump 21. The pumping system will be explained in greater detail with reference to FIG. 5.

As mentioned above, the orifice 8 can be closed by a gate valve 19. The gate valve has a damper 22 operated by an actuator 23. The actuator may be a hydraulic cylinder as shown. The gate valve can be opened from the fully closed position to the fully open position corresponding to virtually 100% of the cross section of the orifice, but may also assume intermediate positions in order to control the discharge of mass from the tank.

The output is primarily controlled by adjusting the gate valve opening. The amount of mass to be discharged is determined by the capacity of the pump 21. For this reason a level gauge (not shown) is provided in the receiving chamber 20, which ensures that the gate valve opening is reduced when the level in the receiving chamber reaches a certain level. In order to leave room for level measuring the shaft to the receiving chamber 20 has a horizontal length greater than that of the valve 19. At the bottom, the receiving chamber 20 turns into a cylinder form in which there is provided a feed screw (not shown) for feeding the drill cuttings into the pump 21. Cleaning nozzles may be fitted in the receiving chamber (preferably in the upper part) for flushing out residual drill cuttings after emptying the tank.

Other types of positive displacement pumps may be used instead of a screw pump 21, e.g. a double piston pump. There are suitable double piston pumps available which are currently used for pumping concrete.

Preferably both the screw pump 21 and the output unit 12 run at a constant speed.

It may be appropriate to operate the feed screw of the pump 21 separately. As mentioned above, there are preferably two feed screws (not shown); a first screw located in the receiving chamber (as mentioned above) and a second screw placed after the first, i.e. in the actual pump casing 21. The feed capacity of the first screw is slightly greater than that of the second screw. This ensures that the entire working volume of the second screw is filled up, thus reducing the risk of water being driven out of the drill cuttings and the drill cuttings compressing into a concrete-like substance. A pump of this type already exists, but is used for other purposes than that of the present invention. Preferably the feed screws are driven directly by a hydraulic motor. This provides ruggedness, excess pressure and torque protection, and small structural dimensions. Downstream of the pump use is preferably made of acidproof smooth steel pipes (optionally with a transition to a hose) having gentle bends and as few cross sectional changes as altogether possible.

Trials have shown that it worked well to have the first feed screw running at a rotational speed of 50% more than that of the second screw. This may be desirable to a certain degree but causes an increase in viscosity and leads to an increased risk of clogging at the end of the receiving chamber. If separate operation of the first screw is to be included, torque control of the screw will be parameter.

There is provided a device 24 for introduction of liquid and/or polymers in the transition between the receiving chamber 20 and the pump casing 21. Addition of up to 20% water with 0.5% polymer has proven to be effective. Injection of green soap can be an alternative to polymer mixing. The drill cuttings will then be mashed and highly viscous, but if the feed is sufficient the pump will also function satisfactorily without addition of polymers. The exiting mass is too viscous to flow but may still be pumped through a piping system without sudden bends. The moment of resistance in the pump is measured by a sensor to determine whether and to what extent liquid must be injected.

The pump and piping must be arranged in a way that makes it possible to use smooth bore pipes having the greatest possible bend radius. Dimensional changes in pipes and between pipes and hoses should be avoided. It is probably sufficient for the pump 21 to have a nominal pressure of 12 bar. The pump may have a guard against dry running and a wear monitor. An unloading line/hose with an internal diameter of between 6" and 8" is suitable. The hose may have an internal plastic coating to make the hose smoother. Preferably the ship is also equipped with these hoses (e.g. on a reel) so as to avoid having to use standard unloading hoses with insufficient smoothness or restrictions.

Preferably there is a pressure gauge in the pump for monitoring the pressure in the pump.

It is also possible to inject air, in addition to water and/or polymer, preferably at the end of the pump 21, as indicated by 25. Air injection in the form of an air blast can break up hard setting of the mass. It is also conceivable to use air blasts en route in the unloading line, in order to help the mass along.

The role of the output unit 10 is to transport mass towards the output orifice 8. The mass should be moved as little as possible by the output unit 10 in order to avoid unnecessary agitation. All the output arms 15, 16 sweep across the flat bottom 6. This carries the mass across a sector of the flat bottom 6 and up to the output orifice 8. In addition, two arms 16 sweep across the conical side 5 of the tank 2 in order to ease the mass movement down towards the bottom 6. As mentioned above, the output orifice 8 extends all the way from the lower edge of the conical side 5 to the conical part 11 of the output mechanism. This will minimize the movement of drill cuttings past the output orifice 8. Ideally, the same mass should not be pushed around more than one revolution along the bottom 6.

Figure 6:
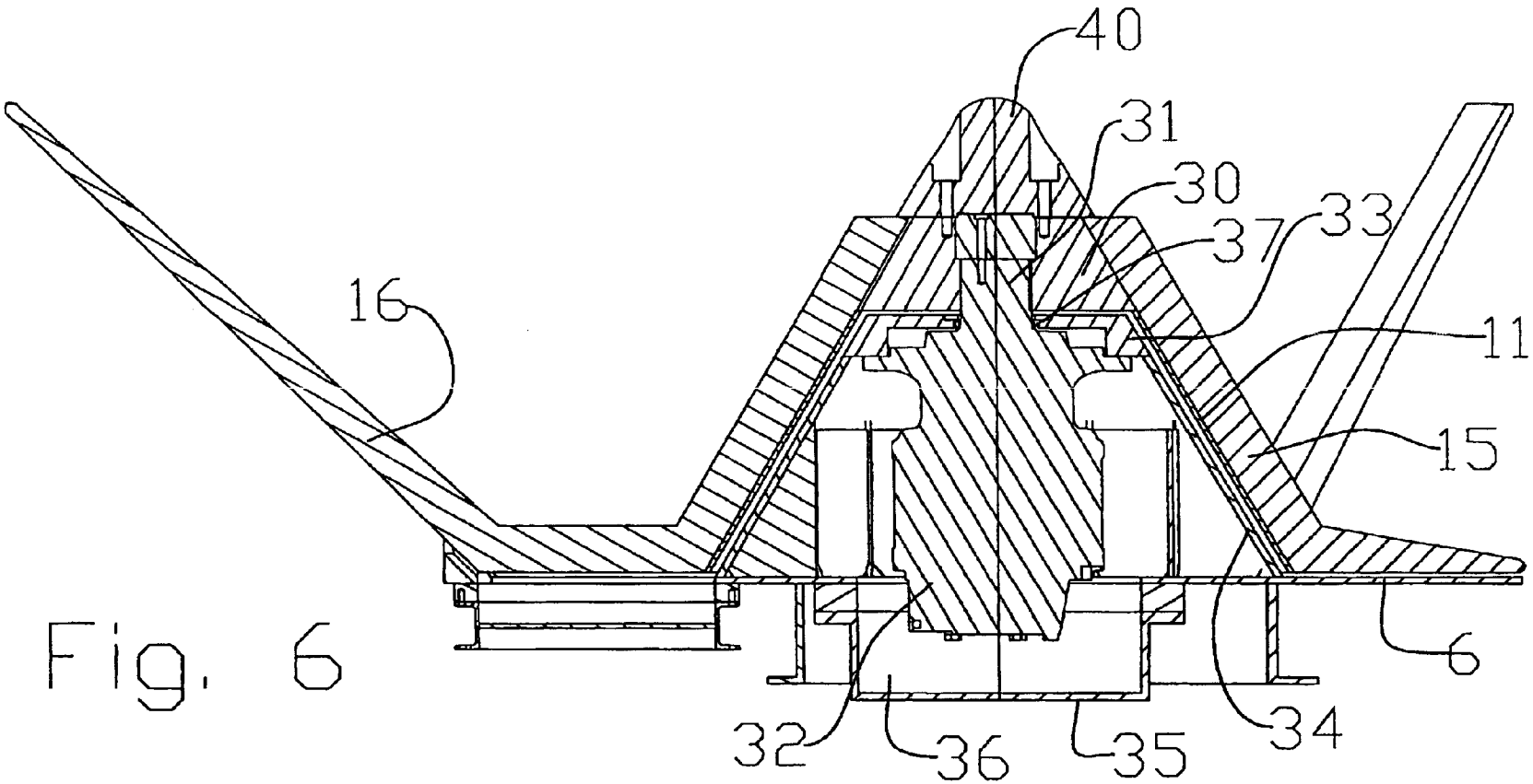
FIG. 6 shows a section through the output mechanism according to the invention.
Figure 7:
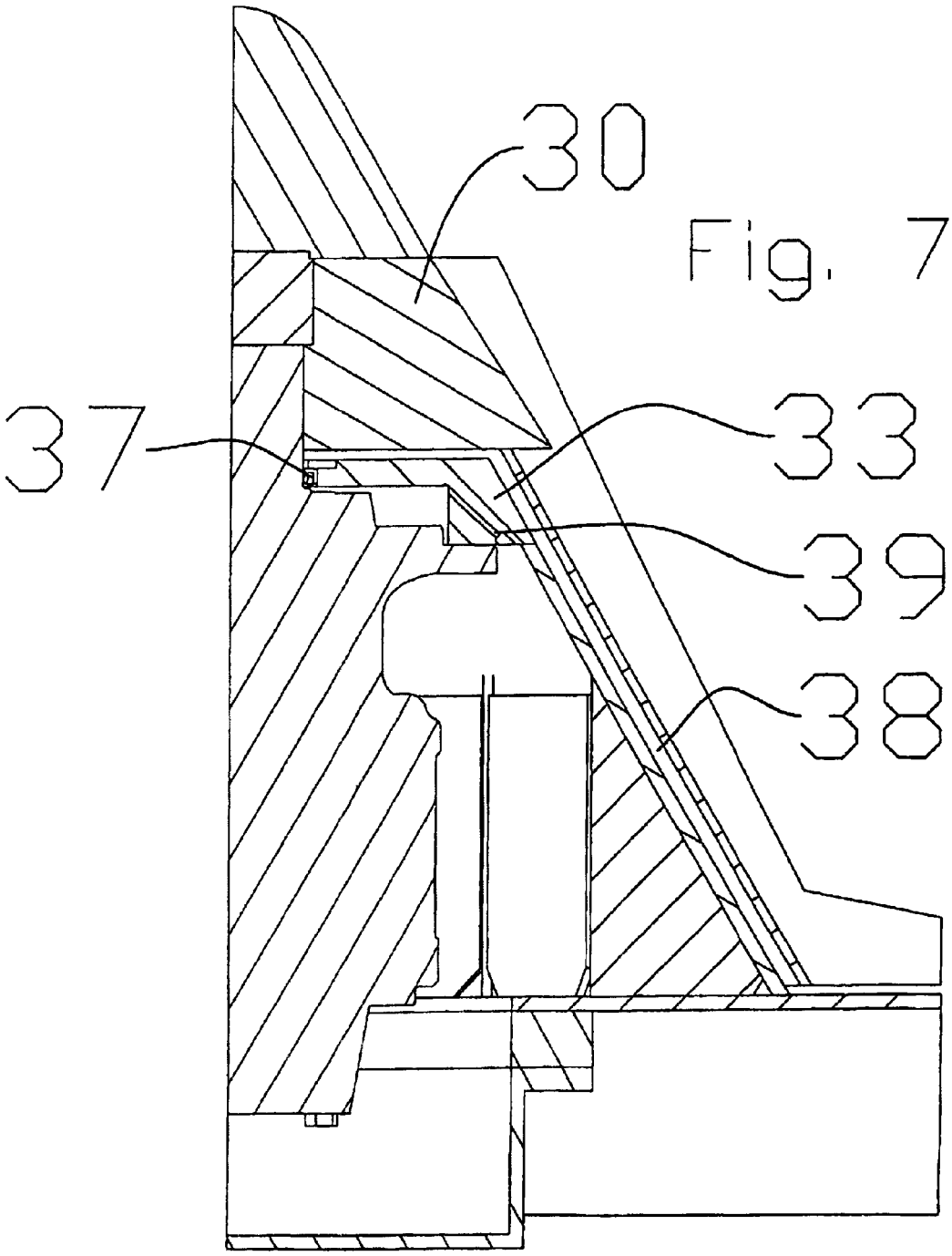
FIG. 7 shows a more detailed section through part of the output mechanism.

The output mechanism will be explained in greater detail with reference to FIGS. 6 and 7. These show the conical part 11 with arms 15 and 16. The arms 15, 16 and the conical part 11 are attached to a hub 30, which in turn is connected to a drive shaft 31 by means of splines. The drive shaft 31 is directly driven by a hydraulic motor 32 fixed to a collar 33. The collar 33 is suspended from an internal cone 34, which in turn is fixed to the bottom 6 of the tank 2.

Underneath the bottom 6 of the tank is a cover 35 that seals a space 36 in which the motor 32 is located. This space 36 is oil-filled. At the drive shaft passage through the collar 33 is a lip seal 37 that seals the oil-filled, space 36 at upper end thereof.

The gap 38 (see FIG. 7) between the conical part 11 and the hub 30 on one side and the internal cone 34 and the collar 33 on the other, is filled with air. This is to prevent to prevent the mass in the tank, which may penetrate in between the conical part 11 and the internal cone 34, from penetrating all the way to the lip seal 37 and causing damage to this. In order to maintain this air seal a channel 39 is provided in the collar 33, through which pressurized air may be supplied to the gap 38.

In the example shown, the motor 32 is installed from below. However, with the appropriate sizing of leadthrough openings, it may just as easily be installed from above.

Above the hub 30 and connected by bolts is a conical top 40. The function of the conical top 40 is to lead the mass out to the conical part 11. The bolt circle in the connection between the conical top 40 and the hub 30 is formed so as to allow the conical top to be replaced with conventional agitator arms if the mass to be transported requires agitation during transport.

Figure 8:
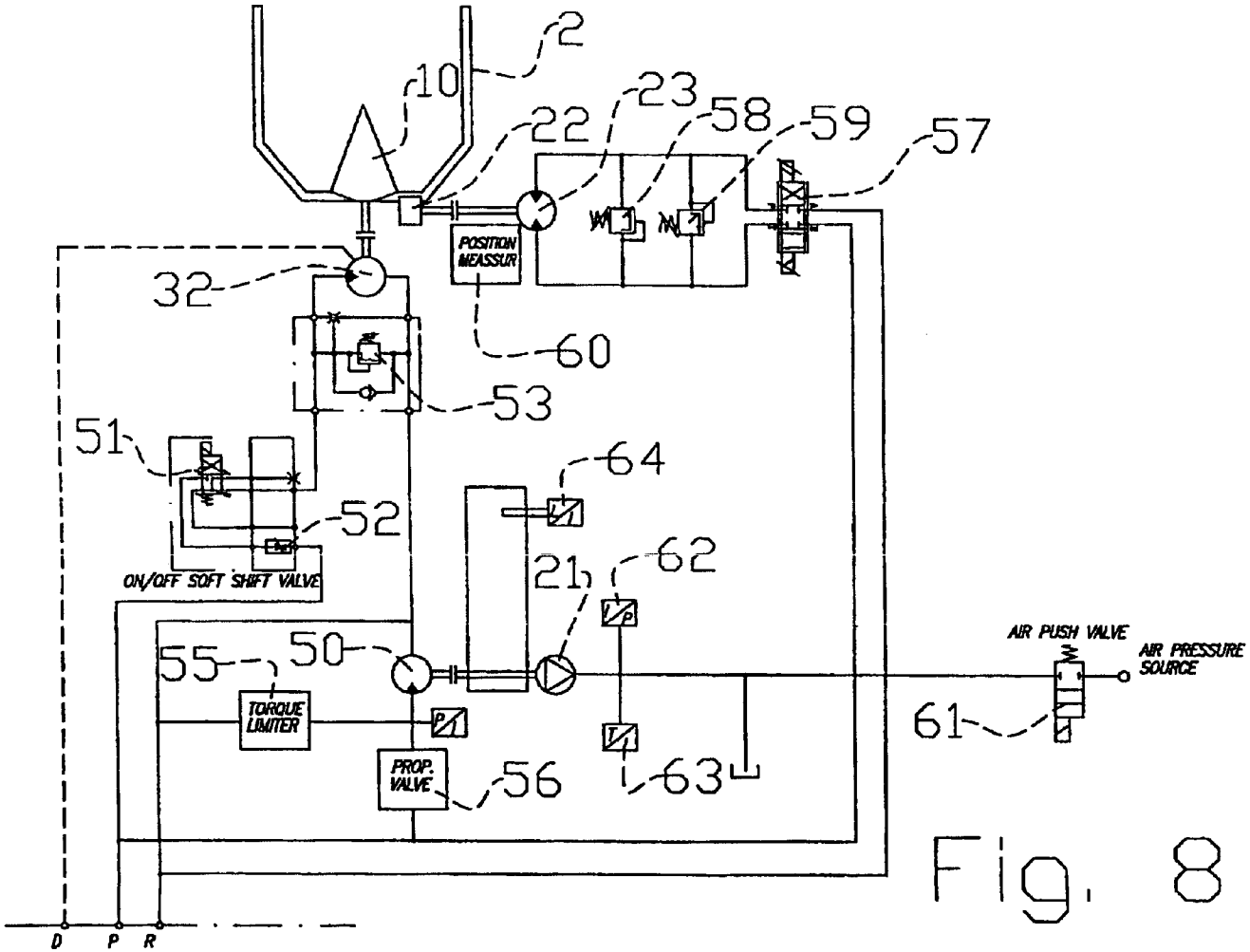
FIG. 8 shows a hydraulic diagram for the output mechanism according to the invention and the pump.

FIG. 8 shows a hydraulic diagram for the transport system according to the present invention. The tank is indicated schematically at 2, the output unit at 10 and the hydraulic motor of the output unit 10 at 32. The figure also shows the actuator 23 for the valve body 22 and the hydraulic motor 50 for the pump 21. The motor 32 for the output unit is controlled by a two-way valve 51 on the discharge side. Here is also a throttle 52 that ensures gentle start-up of the output unit. By the pump 21 is also a pressure relief valve 53. The pump 21 motor 50 is connected in series with the output unit 10 motor 32, ensuring that these motor speeds are always matched. In connection with the motor 50 there is also provided a pressure sensor 54, a torque limiter 55 and a proportional control valve 56.

The actuator 23 of the hydraulically operated valve body 22 is fitted with a three-way valve 57 and pressure relief valves 58 and 59 which act in opposite directions. A position sensor 60 is also provided. The actuator 23 can be operated independently of the motors 32 and 50 and will be the most important means of controlling the output from the tank 2.

FIG. 8 also shows a compressed air system that has a two-way valve 61 and is equipped with a pressure sensor 62 and a temperature sensor 63. This system is provided for imparting air blasts into the mass in the pump in order to prevent hard packing of the mass in the case of low viscosity drill cuttings.

A level sensor 64 is also provided, which measures the level in the pump inlet chamber and increases the feed rate if other parameters allow.

The above describes the pumping equipment as located directly below the tank. However it is not of critical importance for the mass to have a vertical path from the tank and into the pump. The pump may also be placed slightly to one side of the tank to allow the mass to flow into the pump at an angle. By arranging the pump in this manner flow channels from two or more tanks can be directed into the same pump. This allows the number of pumps and associated equipment to be reduced, saving a considerable amount of space. Such a pumping arrangement will be particularly beneficial in the case of low viscosity drill cuttings.

Going out to the drilling platform the tanks may be used to transport e.g. chemicals destined for the drilling platform or ship. The output mechanism can then optionally be used as an agitator, possibly in combination with the above mentioned agitator arms. It would be appropriate to provide EX-protection for all components to allow transport of flammable chemicals. For this reason, the use of electric motors is not preferred.

The invention claimed is:

1. A system for transporting a bulk material containing liquid, the system comprising:

a tank for containing the bulk during transport, the tank having an output unit at the bottom of the tank for feeding the bulk out of the tank by pushing the bulk towards a closable output orifice in the tank bottom, wherein the tank is arranged below deck on a ship and comprises an upper substantially cylindrical part and a lower frustoconical part that ends in a substantially flat bottom, the bottom being limited on its periphery by a side wall of the frustoconical part and having an inner dome or cone arranged centrally thereon, and a positive displacement pump is arranged at a level lower than that of the tank bottom for receiving and advancing the bulk through an unloading line, the unloading line having an essentially uniform cross section;

wherein the positive displacement pump is connected to the output orifice by a liquid tight coupling.

2. A system according to claim 1, wherein the unloading line is made from or has an internal coating of a material with a low friction coefficient.

3. A system according to claim 1, wherein the pump has a first feed screw with a greater feeding capacity than a second downstream feed screw.

4. A system according to claim 1, wherein the output orifice extends from a side wall of the frustoconical part to the inner dome or cone.

5. A system according to claim 4, wherein the dome or cone is formed by a hub in the output unit, the hub including one or more arms arranged to rotate so as to transport the bulk towards the output orifice.

6. A system according to claim 5, wherein the at least one arm extends from the hub to the periphery of the bottom.

7. A system according to claim 6, wherein at least one arm extends at least partway up along a side wall in a conical part of the tank.

8. A system according to claim 5, wherein the output orifice has a valve-arranged to assume several positions between fully closed and fully open, in order to control the output rate of the bulk material containing liquid.

9. A system according to claim 8, wherein the valve is a gate valve.

10. A system according to claim 5, wherein the tank has a greatest diameter of at least 3 meters and no more than half the available inside width of the ship, that the side wall of the conical part has an angle of between 20° and 45°, and that the dome or cone has an angle that lies within the same limits.

11. A system according to claim 4, wherein the output orifice has a valve arranged to assume several positions between fully closed and fully open, in order to control the output rate of the bulk material containing liquid.

12. A system according to claim 7, wherein the tank has a greatest diameter of at least 3 meters and no more than half the available inside width of the ship, that the side wall of the conical part has an angle of between 20° and 45°, and that the dome or cone has an angle that lies within the same limits.

13. A system according to claim 11, wherein the valve is a gate valve.

14. A system according to claim 4, wherein the tank has a greatest diameter of at least 3 meters and no more than half the available inside width of the ship, that the side wall of the conical part has an angle of between 20° and 45°, and that the dome or cone has an angle that lies within the same limits.

* * * * *